US006404129B1

(12) United States Patent
Hendricx et al.

(10) Patent No.: US 6,404,129 B1
(45) Date of Patent: Jun. 11, 2002

(54) METAL HALIDE LAMP

(75) Inventors: Josephus Christiaan Maria Hendricx; Herman Muller; Petrus Antonius Marie Weerdesteijn; Arnoldus Johanna Walravens, all of Eindhoven (NL)

(73) Assignee: Koninklijke Philips Electronics N.V. (NL)

( * ) Notice: Subject to any disclaimer, the term of this patent is extended or adjusted under 35 U.S.C. 154(b) by 0 days.

(21) Appl. No.: 09/561,614

(22) Filed: Apr. 27, 2000

(30) Foreign Application Priority Data

Apr. 29, 1999 (EP) ..... 99201336

(51) Int. Cl.[7] ..... H01J 17/16

(52) U.S. Cl. ..... 313/620; 313/637

(58) Field of Search ..... 313/493, 620, 313/631, 634, 573, 574, 637

(56) References Cited

FOREIGN PATENT DOCUMENTS

WO W09825294 6/1998 ..... H01J/61/02

*Primary Examiner*—Vip Patel
(74) *Attorney, Agent, or Firm*—Dicran Halajian

(57) ABSTRACT

The invention relates to a metal halide lamp which is provided with a discharge vessel having a ceramic wall and enclosing a discharge space. Two electrodes having tips at a mutual distance EA are positioned in the discharge space, which contains besides Xe also an ionizable filling with NaI and $CeI_3$. The discharge vessel has an internal diameter Di at least over the length EA. According to the invention it holds that Di<1.4 mm and also that the relation EA/Di<5 is complied with.

9 Claims, 2 Drawing Sheets

METAL HALIDE LAMP

BACKGROUND OF THE INVENTION

The invention relates to a metal halide lamp provided with a discharge vessel having a ceramic wall which encloses a discharge space, in which discharge space, which contains Xe and an ionizable filling with NaI and $CeI_3$, two electrodes are arranged whose tips have a mutual interspacing EA, while the discharge vessel has an internal diameter Di at least over the distance EA.

A lamp of the kind mentioned in the opening paragraph is known from WO 98/25294-A (PHN 16.105). The known lamp has a high luminous efficacy and good color properties (among which a general color rendering index $R_a$ of between 40 and 65 and a color temperature $T_c$ of between 2600 and 4000 K) and is highly suitable as a light source for public lighting. The recognition that an acceptable color rendering is possible when Na-halide is used as a filling ingredient of a lamp and a strong widening and reversion of the Na emission in the Na-D lines takes place is utilized in this lamp. This effect requires a high temperature of the coldest spot $T_{kp}$ in the discharge vessel of, for example, 1170 K (900° C.). Inversion and widening of the Na-D lines causes these lines to assume the form of an emission band in the spectrum with two maxima at a mutual interspacing $\Delta\lambda$.

The requirement that $T_{kp}$ should have a high value excludes the use of quartz or quartz glass for the discharge vessel wall and necessitates the use of a ceramic material for the discharge vessel wall.

A ceramic wall in the present description and conclusions is understood to mean both a wall made of metal oxide, such as, for example, sapphire densely sintered polycrystalline $Al_2O_3$ or YAG, and a wall made of metal nitride, for example AIN.

The known lamp not only has an acceptable color rendering but also a very high luminous efficacy. The filling of the discharge vessel for this purpose comprises Ce iodide in addition to Na-halide. The discharge vessel further contains Xe.

A disadvantage of the known lamp is that it has a comparatively wide electrode interspacing and accordingly a very elongate shape, which renders the lamp less suitable for optical applications in which an accurate focusing of the generated light is required.

SUMMARY OF THE INVENTION

The invention has for its object to provide a measure by which the above disadvantage is eliminated.

According to the invention, a lamp of the kind mentioned in the opening paragraph is for this purpose characterized in that $Di \leqq 2$ mm, and the relation $EA/Di < 5$ is complied with.

The lamp according to the invention has the advantage that the discharge vessel has very compact dimensions which render the lamp highly suitable for use in a headlamp for a motor vehicle. Owing to the small internal diameter in comparison with the electrode spacing, and thus the discharge arc length, the discharge arc is hemmed in by the discharge vessel wall, so that the discharge arc has a sufficiently straight shape for it to be suitable for use as a light source for a motor vehicle headlamp. An internal diameter $Di \leqq 2$ is found to be of essential importance for realizing a sharp beam delineation necessary for use in motor vehicles in combination with a small spot of high brightness immediately adjacent this delineation. Preferably, $Di \leqq 1.4$ mm. Such a very small internal diameter renders the lamp particularly suitable for use as a light source in a complex-shape headlamp. An advantage of such a headlamp is that no separate passing-beam cap is required in the formation of the light beam to be generated in order to realize a sufficiently sharp beam delineation. The Di, however, is chosen to be so great that a minimum switching life of 2000 hours can be realized. Preferably, the relation $EA/Di > 2.75$ is also complied with. It is achieved in this manner that a sufficiently great value for EA can still be realized while retaining sufficiently small dimensions of the optically active source. The lamp is particularly suitable for use in a headlamp with a European passing beam when the internal diameter Di is chosen such that the relation $1.4 < Di \leqq 2$ is complied with. A passing-beam cap will generally be used here which intercepts part of the light emitted between the electrode tips such that the beam formed by the lantern avoids dazzling of oncoming traffic.

The optical dimensions of the light source are furthermore favorably influenced by a suitable choice of the wall thickness. This is preferably chosen such that the wall of the ceramic discharge vessel has a thickness of at most 0.4 mm at least over the distance EA. If the lamp serves as a complex-shape lantern, the wall thickness of the discharge vessel will preferably be at most 0.3 mm. Although the ceramic wall material in itself has generally strongly light-scattering properties, a light source is here advantageously realized which has optical dimensions comparable to usual dimensions of existing headlamps fitted with incandescent coils.

It is necessary that sufficiently high concentrations of Na and Ce should be present in the discharge so as to achieve a high luminous efficacy and good color properties, which manifest themselves in the value of $\Delta\lambda$. The value of $\Delta\lambda$ depends inter alia on the molar ratio $NaI:CeI_3$ and the level of $T_{kp}$. It was found in the lamp according to the invention that a value for $\Delta\lambda$ of at least 3 nm is required. Preferably, the value of $\Delta\lambda$ is $\leqq 6$ nm.

Further experiments have shown that it is desirable for the discharge vessel of the lamp to have a wall load of $\leqq 120$ $W/cm^2$. The wall load is defined here as the quotient of the lamp power and the outer surface of that portion of the discharge vessel wall which is situated between the electrode tips. It is achieved thereby that a required high value of $\Delta\lambda$ can be realized while at the same time the maximum wall temperature of the discharge vessel remains limited during lamp operation. The temperatures and pressures prevailing in the discharge vessel in the case of wall load values above 120 $W/cm^2$ become such that chemical processes attacking the discharge vessel wall give rise to an unacceptable shortening of lamp life. In addition, thermal stresses in particular resulting from temperature gradients during heating-up after ignition and cooling-down after extinguishing of the lamp form a source of an unacceptable shortening of lamp life.

In an advantageous embodiment of the lamp according to the invention, the discharge vessel is closed off at one end by a ceramic projecting plug, and a portion of the ceramic projecting plug and an adjoining portion of the ceramic discharge vessel are provided with an external coating. This achieves on the one hand a better temperature control and thus a higher temperature of iodide salts in the filling and on the other hand a cutting-off of light which issues behind the electrode tip, which is highly favorable for realizing a sharp beam delineation. Pt is found to be highly suitable as a material for the coating. A further advantage is that blackening of the wall behind the electrode does not affect the lumen output of the lamp. A lamp suitable for a complex-shape lantern is preferably provided with an external coating at both ends. Although a coating at that end of the discharge vessel which is at the lamp cap side could suffice, the provision of the coating at both ends achieves a symmetrical construction of the discharge vessel. This is of major advantage both in the manufacture of the discharge vessel and during subsequent mounting of the lamp. The coating preferably extends over the ceramic discharge vessel up to at least 0.5 mm from the electrode tip. On the other hand, the coating preferably does not extend beyond the electrode tip, since this would adversely affect the lumen output of the lamp.

According to the invention, the molar ratio $NaI:CeI_3$ lies between 2 and 25. It is found on the one hand that the luminous efficacy becomes unacceptably low and on the other hand that the light radiated by the lamp contains an excess quantity of green in the case of a ratio below 2. A correction of the light color, for example through the addition of salts to the ionizable filling of the discharge vessel, is only possible in this case to the detriment of the luminous efficacy. If the ratio is above 25, however, the influence of the Ce on the color properties of the lamp is so small that these strongly resemble those of the known high-pressure sodium lamps. It was found to be desirable that the lamp should radiate light with a color temperature $T_c$ of at least 3000 K, and preferably between 3500 K and 4500 K, if it is to be used for a motor vehicle headlamp. To increase the color temperature value achievable with $NaI—CeI_3$, it is possible, for example, to add $CaI_2$ and $DyI_3$ to the ionizable filling, for example in molar percentages 47 Na, 7.7 Ce, 39.2 Ca, and 6.1 Dy.

Xe is added to the ionizable filling of the discharge vessel with a high filling pressure. The Xe here ensures a fast lumen output immediately after ignition of the lamp. The choice of the filling pressure of the rare gas in addition influences the heat balance of the discharge vessel, and thus the useful life of the lamp. It was found that a pressure of at least 5 bar is required for realizing a lamp life of 10,000 switching operations. Preferably, the filling pressure lies in a range from 7 bar to 20 bar, more in particular from 10 bar to 20 bar. This offers a possibility of realizing switching lives of 20,000 switching operations and more.

BRIEF DESCRIPTION OF THE DRAWINGS

The above and further aspects of the lamp according to the invention will now be explained with reference to a drawing (not true to scale), in which FIG. 1 diagrammatically shows a lamp according to the invention.

DETAILED DESCRIPTION OF THE PREFERRED EMBODIMENTS

Figure 1:
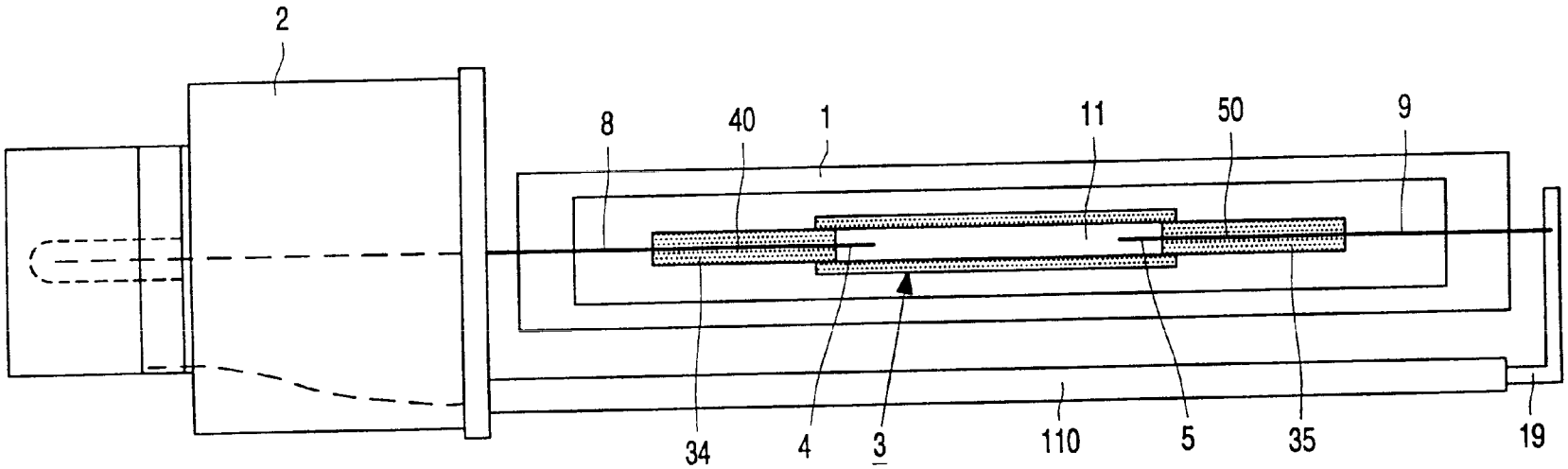
Figure 2:
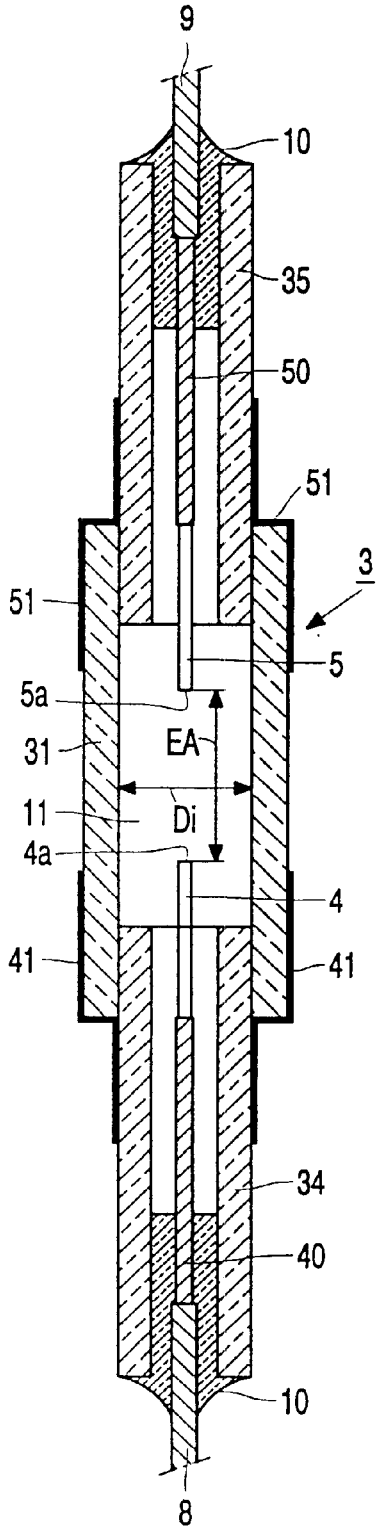
FIG. 2 shows the discharge vessel of the lamp of FIG. 1 in detail.

FIG. 1 shows a metal halide lamp provided with a discharge vessel 3. The discharge vessel 3 is shown in more detail in FIG. 2, with a ceramic wall 31 which encloses a discharge space 11 containing Xe and an ionizable filling with NaI and $CeI_3$. Two electrodes with tips 4*a*, 5*a* having an interspacing EA are arranged in the discharge vessel, which has an internal diameter Di at least at the area of the interspacing EA.

The discharge vessel is closed off at either end by a respective ceramic projecting plug 34, 35 which encloses with narrow interspacing a respective current lead-through conductor 40, 50 to the electrode 4, 5 arranged in the discharge vessel and which is connected to the relevant conductor in a gastight manner by means of a melting-ceramic joint 10 at an end facing away from the discharge space. The discharge vessel is surrounded by an outer bulb 1. Part of the ceramic projecting plug 34, 35 and an adjoining portion of the ceramic discharge vessel 3 are provided with an external coating 41, 51. The lamp is further provided with a lamp cap 2. A discharge extends between the electrodes 4 and 5 in the operational state of the lamp. The electrode 4 is connected to a first electrical contact forming part of the lamp cap 2 via a current conductor 8. The electrode 5 is connected to a second electrical contact forming part of the lamp cap 2 via current conductors 9 and 19. The current conductor 19 is surrounded by a ceramic tube 110.

In a practical realization of a lamp according to the invention as represented in the drawing, a number of lamps were manufactured with a rated power of 26 W each. The lamps are suitable for use as headlamps in a motor vehicle. The ionizable filling of the discharge vessel of each individual lamp comprises 0.35 mg Hg and 0.7 mg NaCe iodide in a molar percentage of 85.7 Na and 14.3 Ce (molar ratio 6:1). The filling further comprises Xe with a filling pressure at room temperature of 7 bar.

The distance between the electrode tips EA is 5 mm, the internal diameter Di is 1.4 mm, so that the ratio EA/Di=3.57. The wall thickness of the discharge vessel is 0.3 mm. The lamp accordingly has a wall load of 83 $W/cm^2$. Part of the ceramic projecting plug and an adjoining portion of the ceramic discharge vessel are provided with an external coating of Pt. The external coating extends to 0.25 mm from the relevant electrode tip. The outer bulb of the lamp is made of quartz glass. The internal diameter of the outer bulb is 3 mm, its wall thickness is 2 mm. The outer bulb is filled with $N_2$ with a filling pressure of 1.5 bar.

The lamp has a luminous efficacy of 82 lm/W in its operational state. The light radiated by the lamp has values for $R_a$ and $T_c$ of 65 and 3500 K, respectively, at a lamp life of 250 hours. The value of $\Delta\lambda$ here is 6.2 nm. The values of the above quantities have become 74 lm/W, 69, 3650 K, and 6.6 nm after 2000 hours of operation.

A further series of comparable lamps was subjected to a switching life test. The external coating in this case extended to 0.5 mm from the relevant electrode tip. After 500 switching operations, the values of the luminous efficacy, $R_a$, $T_c$, and $\alpha\lambda$ were 77 lm/W, 65, 3300 K, and 6 nm, respectively. The values were 72 lm/W, 73, 3590 K, and 6.5 nm after 41,000 switching operations. For comparison, it is noted that a high-pressure mercury lamp used as a discharged lamp in a motorcar lantern and provided with a quartz glass discharge vessel (make Philips, type D2R) has a power rating of 35 W and a luminous efficacy of 80 lm/W. The light radiated by this lamp has the following properties: $T_c$=4000 K and $R_a$=69. The known lamp is not designed for use in a complex-shape lantern.

In a modified design, lamps according to the invention are suitable for use in a headlamp with European passing beam. The lamps are designed for a power rating of 35 W. The lamp has a quartz glass outer bulb provided with a band-shaped coating for realizing the required passing beam, for example for forming a sufficiently sharp beam delineation. In a preferred embodiment, this coating is electrically conducting, whereby a reduction in the ignition voltage is realized. A further reduction in the ignition voltage is advantageously achievable in that the discharge vessel is provided with a metal track, for example made of W, at its outer surface.

In an alternative embodiment of the lamp according to the invention, the outer bulb is provided with a heat-reflecting coating at the area of the ceramic projecting plug. This coating may be used in combination with a coating on the discharge vessel as well as instead of an external coating on the discharge vessel. Preferably, the reflecting coating is provided on the inner surface of the wall of the outer bulb, since this method leads to a smaller loss in luminous flux in the beam than in the case of an externally provided coating.

The scope of the invention is not limited to the embodiments. The invention is embodied in each new characteristic and each combination of characteristics. Any reference sign do not limit the scope of the claims. The word "comprising" does not exclude the presence of other elements or steps than those listed in a claim. Use of the word "a" or "an" preceding an element does not exclude the presence of a plurality of such elements.

What is claimed is:

1. A metal halide lamp provided with a discharge vessel having a ceramic wall which encloses a discharge space, in which discharge space, which contains Xe and an ionizable filling with NaI and $CeI_3$, two electrodes are arranged whose tips have a mutual interspacing EA, while the discharge vessel has an internal diameter Di at least over the distance EA, characterized in that $Di \leqq 2$ mm, and the relation $EA/Di<5$ is complied with.

2. A lamp as claimed in claim 1, characterized in that $Di \leqq 1.4$ mm, and that the relation $EA/Di>2.75$ is also complied with.

3. A lamp as claimed in claim 1, characterized in that the discharge vessel of the lamp has a wall load with a value $<120$ W/cm$^2$.

4. A lamp as claimed in claim 1, characterized in that the relation $1.4<Di \leqq 2$ is complied with.

5. A lamp as claimed in claim 1, characterized in that the wall of the ceramic discharge vessel has a thickness of at most 0.4 mm at least over the distance EA.

6. A lamp as claimed in claim 1, characterized in that the discharge vessel is closed off at one end by a ceramic projecting plug, and a portion of the ceramic projecting plug and an adjoining portion of the ceramic discharge vessel are provided with an external coating.

7. A lamp as claimed in claim 1, characterized in that the Xe has a filling pressure of at least 5 bar.

8. A lamp as claimed in claim 7, characterized in that the Xe has a filling pressure which lies in a range from 7 bar to 20 bar.

9. A lamp as claimed in claim 1, characterized in that the NaI and the $CeI_3$ are present in a molar ratio which lies in a range from 3 to 25.

* * * * *